US005649688A

United States Patent [19]

Baker

[11] Patent Number: 5,649,688

[45] Date of Patent: Jul. 22, 1997

[54] RAILINGS WITH CONTINUOUS SPACERS

[76] Inventor: Neill E. Baker, 13900 - 60th Avenue, Surrey, British Columbia, Canada, V5W 1S7

[21] Appl. No.: 390,659

[22] Filed: Feb. 17, 1995

[51] Int. Cl.[6] ..... E04H 17/22

[52] U.S. Cl. ..... 256/21; 256/22; 256/59; 256/65

[58] Field of Search ..... 256/21, 22, 23, 256/30, 31, 59, 64, 65, 72

[56] References Cited

U.S. PATENT DOCUMENTS

| | | | |
|---|---|---|---|
| 342,765 | 5/1886 | Suydam | 256/65 |
| 936,246 | 10/1909 | Josler | 256/22 |
| 1,376,150 | 4/1921 | Miller | 256/21 X |
| 2,371,921 | 3/1945 | Tucker | 256/22 X |
| 2,654,579 | 10/1953 | Cremens | 256/65 X |
| 3,083,951 | 4/1963 | Huret | 256/65 |
| 3,221,467 | 12/1965 | Henkels | 52/690 |
| 3,246,879 | 4/1966 | Case et al. | 256/65 X |
| 3,357,681 | 12/1967 | Souza, Jr. | 256/22 X |
| 3,411,752 | 11/1968 | Bos | 256/22 |
| 3,955,799 | 5/1976 | Lauzier | 256/65 X |
| 3,955,800 | 5/1976 | Russo | 256/59 |
| 3,962,774 | 6/1976 | Noro | 256/22 X |
| 4,015,826 | 4/1977 | Lauzier | 256/59 |
| 4,334,671 | 6/1982 | De Guise | 256/22 X |
| 4,451,025 | 5/1984 | Spera | 256/22 X |
| 4,586,697 | 5/1986 | Tornya | 258/65 |
| 4,690,383 | 9/1987 | Batcheller | 256/24 |
| 4,805,879 | 2/1989 | Spera | 256/22 X |
| 4,920,717 | 5/1990 | Hooper, Jr. | 256/59 |
| 4,982,933 | 1/1991 | Schultz | 256/22 X |
| 5,143,416 | 9/1992 | Karapetian | 256/65 X |
| 5,200,240 | 4/1993 | Baker | 428/34.1 |

*Primary Examiner*—Brian K. Green
*Assistant Examiner*—Andrea Chop
*Attorney, Agent, or Firm*—Norman M. Cameron

[57] ABSTRACT

A railing includes a top member having a downwardly opening first channel with a bottom and a bottom member having an upwardly opening second channel with a top. There is a plurality of spaced-apart vertical pickets, each picket having a top end in the first channel and a bottom end in the bottom channel. There are spacers adjacent the top and bottom members. Each spacer is an elongated, continuous member with a plurality of spaced-apart openings. Each spacer has a connector engaging one of the top and bottom members. The pickets extend through the openings in the spacers. There may be resilient members along the channels. During assembly the resilient members are first fitted within the channels and the spacer members are then secured to the top and bottom members. The pickets can then be inserted through the openings in the elongated members. The elongated members are then brought towards each other and secured in place with the pickets compressing the resilient members.

16 Claims, 4 Drawing Sheets

RAILINGS WITH CONTINUOUS SPACERS

BACKGROUND OF THE INVENTION

This invention relates to railings, in particular aluminum railings of the type having upper and lower horizontal members with a plurality of pickets extending therebetween, the pickets being received by continuous spacers on the upper and lower members.

Component railing systems, typically made of aluminum, have become increasingly popular because of their pleasing appearance, relatively low cost and general ease of assembly and installation. One such railing system, for example, is disclosed in U.S. Pat. No. 5,200,240 to Neill Baker.

Many such railing systems incorporate a plurality of spaced-apart pickets extending between top and bottom members. The top and bottom members may have channels for receiving the tops and bottoms of the pickets. In some earlier systems individual spacers were fitted over the channels between the pickets during the assembly operation. An appreciable amount of time and labor must therefore be spent on the job site fitting the pickets into the upper and lower members and then fitting the spacers individually.

SUMMARY OF THE INVENTION

It is therefore an object of the invention to provide an improved railing system where pickets can be easily fitted without requiring individual spacers between adjacent pickets.

It is also an object of the invention to provide an improved railing system which can be installed faster and less expensively than prior art railing systems of the general type.

It is a further object of the invention to provide an improved aluminum railing system which can accommodate variations in height of the deck surface.

It is a still further object of the invention to provide an improved railing system which is rugged, inexpensive to produce and install, and which is durable and safe.

In accordance with these objects, there is provided a railing which includes a top member having a downwardly opening first channel with a bottom. There is also a bottom member having an upwardly opening second channel with a top. There is a plurality of spaced-apart vertical pickets, each having a top end in the first channel and a bottom end in the second channel. There are spacers adjacent the top and bottom members, each spacer being an elongated, continuous member with a plurality of spaced-apart openings. Each spacer has a connector engaging one member. The pickets extend through the openings in the spacers.

Preferably, the spacers are resilient and U-shaped in section with inwardly directed projections on each side thereof forming the connectors.

Preferably there are resiliently deformable members within the channels above and below the pickets.

There is also provided a method of assembling railing apparatuses having an upper elongated member with a downwardly directed channel and a lower elongated member with an upwardly directed channel and plurality of spaced-apart vertical pickets therebetween. The method comprises placing resilient members along the channels of the elongated members. Continuous spacer members are fitted to the channels. The spacer members have a plurality of spaced-apart openings. The pickets are inserted through the openings in the elongated members. The elongated members are brought towards each other so the pickets compress the resilient members.

Preferably one of the elongated members is fastened to a support post prior to inserting the pickets and the other elongated member is secured in place after the elongated members are brought towards each other.

DESCRIPTION OF THE PREFERRED EMBODIMENTS

Figure 1:
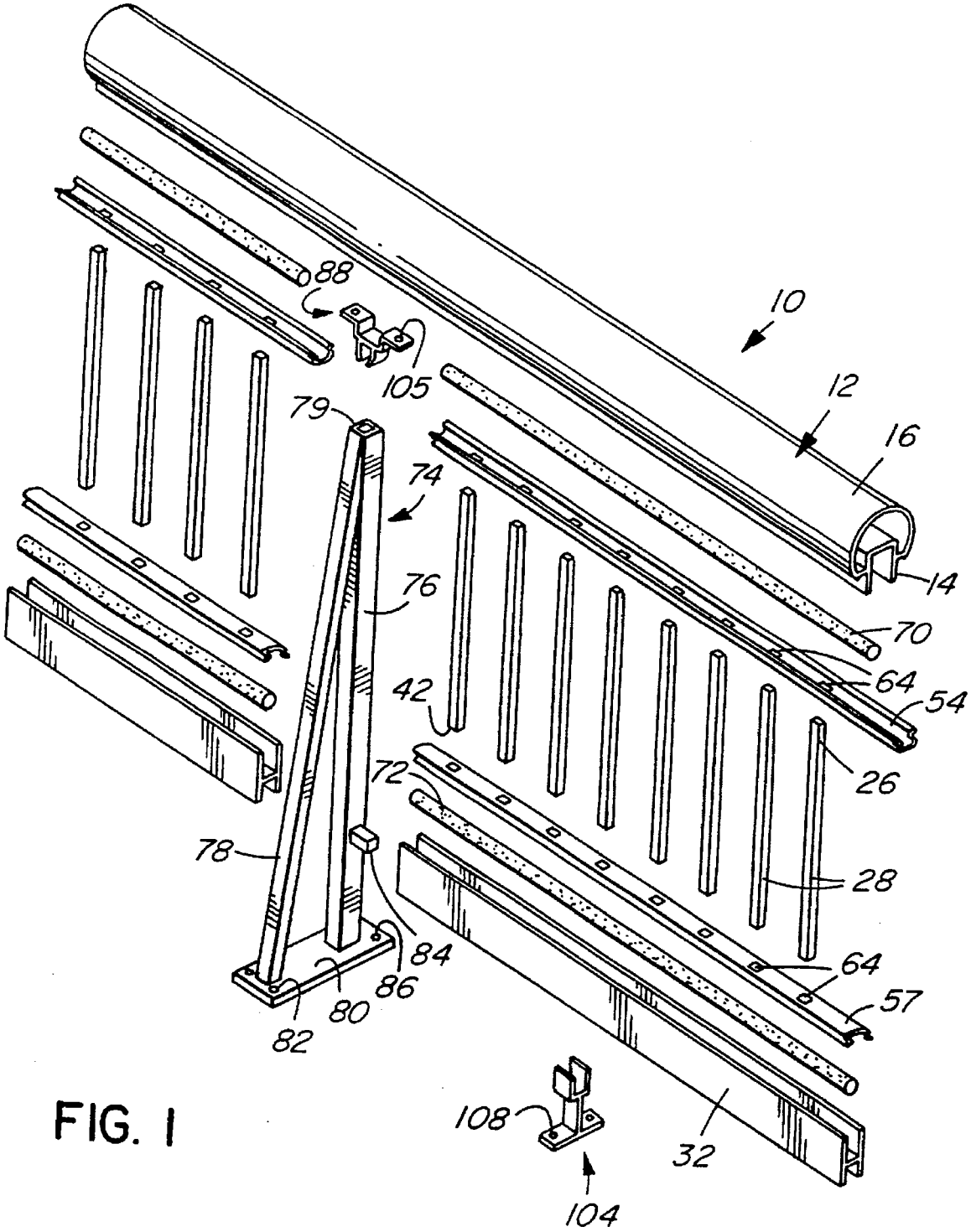
FIG. 1 is an exploded isometric view of a railing according to an embodiment of the invention.
Figure 2:
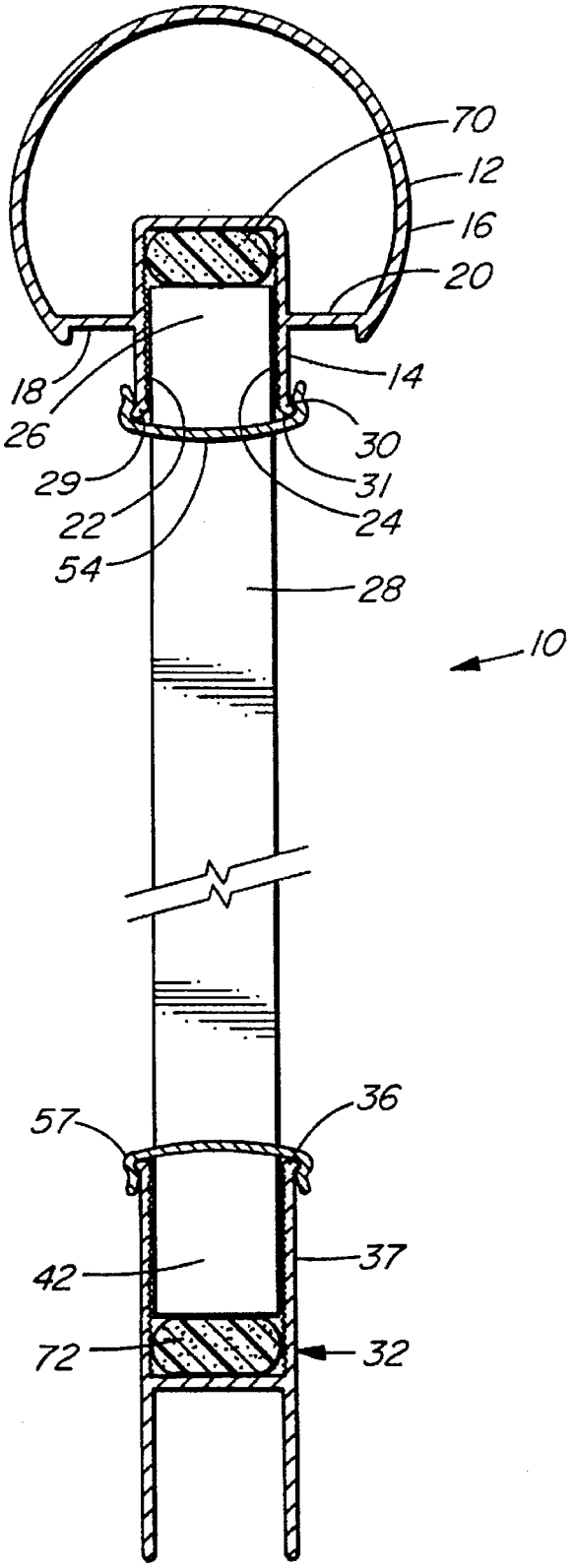
FIG. 2 is a sectional view of the railing of FIG. 1 with the pickets thereof shown in fragment.

Referring first to FIG. 1 and 2, these show a railing 10 which is generally similar in construction to the railing disclosed in U.S. Pat. No. 5,200,240. Such railings are made of a plurality of extruded aluminum members which are generally assembled at a job site prior to installation. The railing includes an elongated top member 12 which is rounded in this embodiment, but can be square in section or of other shapes. The member 12 has a downwardly opening channel 14 connected to curved portion 16, forming the top of the member, by webs 18 and 20. Inner sides 22 and 24 of the channel are serrated in order to grip tops 26 of a plurality of pickets 28. There are lateral rounded protrusions 29 and 30 extending outwardly on each side of channel 14 adjacent its bottom 31 in this example. Additional members 12 may be required to give the desired length of railing.

Figure 3:
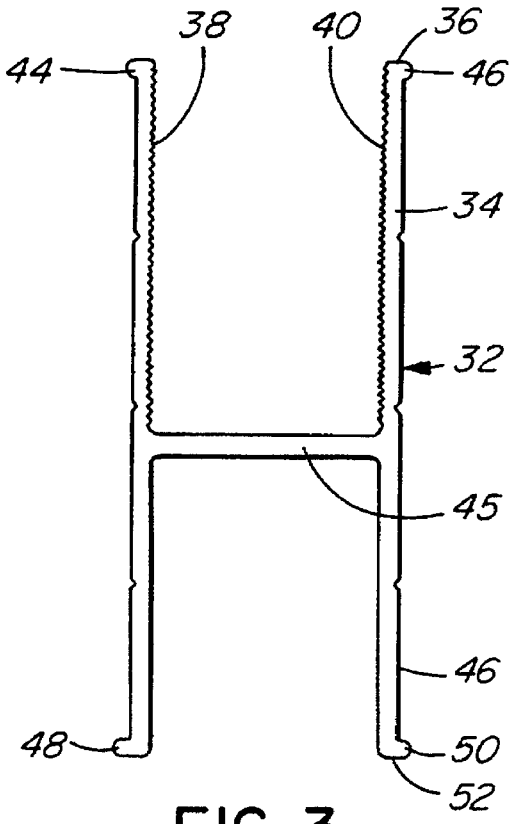
FIG. 3 is an end view of the bottom elongated member thereof.

There are also bottom members 32 which in this case are H-shaped as seen best in FIG. 2 and 3. Each bottom member has an upwardly opening channel 34 with a top 36. Like channel 14, channel 34 has inner sides 38 and 40 which are serrated to tightly receive the pickets 28, in this case their bottoms 42. Also like the channel 14 of the top member, channel 34 has outwardly directed, lateral protrusions 44 and 46 along its top 36. The member 32 has a web 44 which separates channel 34 from a bottom, downwardly facing channel 47. The bottom channel has outwardly directed lateral protrusions 48 and 50 adjacent its bottom 52.

Figure 4:
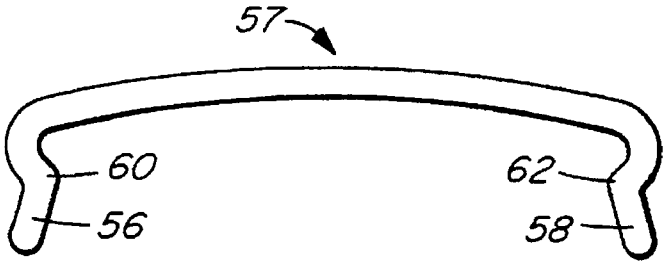
FIG. 4 is an end view of one of the continuous spacers thereof.

There are elongated spacers 54 and 57 in the form of elongated, continuous members extending along the bottom of top member 12 and the top of bottom member 32. In this example the spacers are identical. They are shown in better detail in the enlarged views of FIG. 4 and 5 which show spacer 57. The spacers are generally U-shaped in section as shown in FIG. 4. The spacer has a pair of sides 56 and 58 with inwardly directed projections 60 and 62. The spacers are resilient, aluminum in this example, allowing them to be snapped in place over the bottom 31 of channel 14 on the top member and the top 36 of the bottom member 32 as seen in FIG. 2. The projections 60 and 62 snap over the protrusions 29 and 30 of the top member and the corresponding protrusions 44 and 46 of the bottom member, serving as connectors to secure the spacers to the top and bottom members respectively.

Figure 5:
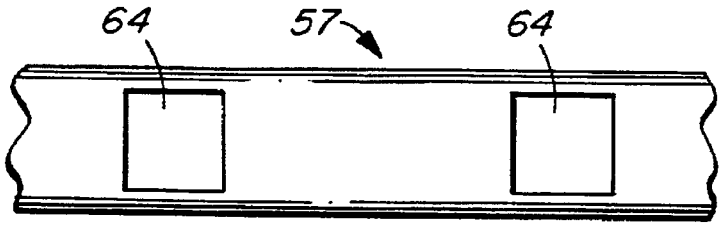
FIG. 5 is a top, plan fragmentary view of one of the spacers.

Each spacer has a plurality of spaced-apart openings 64 therein as seen in FIG. 1 and 5. In this example the openings are square to correspond to the shape of the pickets 28 which are also square in section in this embodiment. The opening 64 are slightly larger than the pickets to slidably receive the same.

There are resiliently deformable members 70 and 72 within the channels 14 and 34 respectively as shown in FIG. 2. When undeformed, these are elongated, cylindrical rods as seen in FIG. 1. In this example they are of a closed-cell resilient polymer or plastic. These members are compressed between the tops and bottoms of the pickets 28 and the top and bottom members 12 and 32 respectively when the railing is assembled as shown in FIG. 2.

The railing 10 includes a plurality of spaced-apart supports 74, only one of which is shown in FIG. 1. The supports 74 are generally conventional, having a vertical tube 76 which is square in section in this embodiment. A second, smaller tube 78 is connected to tube 76 adjacent its top 79 and is angled outwardly and downwardly therefrom. Both tubes are connected to a base plate 80 having a plurality of apertures for receiving anchor bolts, screws or the like to secure the support 74 to a surface. There are projections 84 on each side of the tube 76 adjacent its bottom 86. When assembled, the projections 84 fit within the channels 46 of the bottom members 32.

Figure 8:
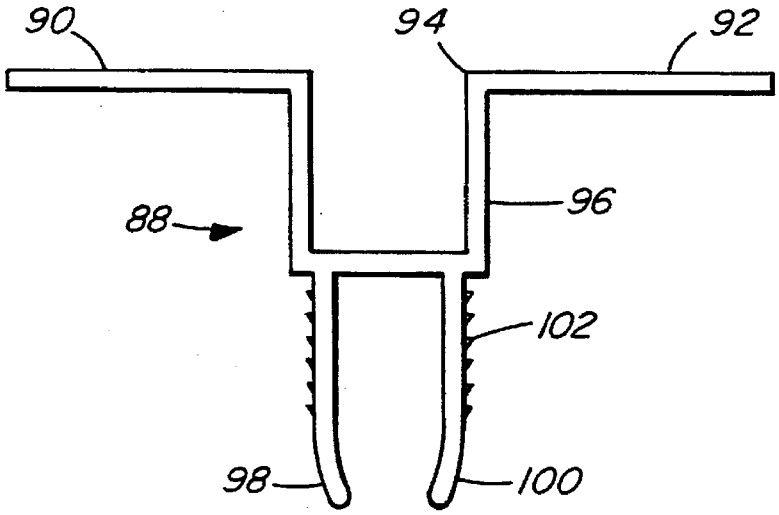
FIG. 8 is an end view of a top post connector of the railing.

There is a generally T-shaped top post connector 88 at the top of each post as shown in FIG. 1 and 8. Each has a pair of co-planar flanges 90 and 92 which extend away from each other at top 94 of the connector. Central portion 96 of the connector extends downwardly and terminates in a pair of spaced-apart flanges 98 and 100 which have spaced-apart outwardly extending lateral projections 102 thereon. In this example the flanges are parallel near their tops and angled towards each other at their bottoms. The flanges 98 and 100 are received against the inside of tube 76 adjacent top 79 thereof and the projections 102 grip the tube. As seen in FIG. 1 there are apertures 105 on each side of the top of the connector to receive screws which secure the connector to the bottom of top member 12.

Figure 7:
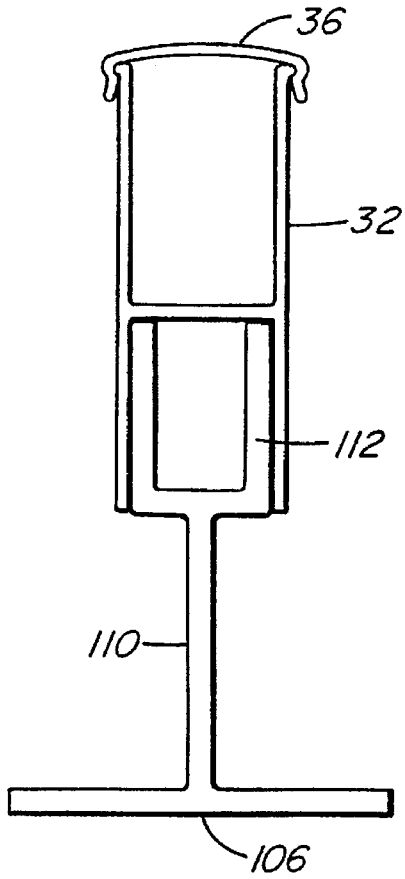
FIG. 7 is an end view of the bottom elongated member with a spacer and a mount connected thereto.

There are also intermediate bottom supports 104 optionally provided between supports 74 as seen in FIG. 1 and 7. Each is generally inverted T-shaped having a bottom plate 106 with apertures 108 therein for receiving the bolts to secure the bottom plate to a deck surface. There is an upwardly extending web 110 and a bifurcated upper portion 112 adapted to tightly engage the inside of channel 46 of bottom member 32. Supports 104 provide additional support for the bottom members, particularly for long spans of railing between supports 74.

Figure 6:
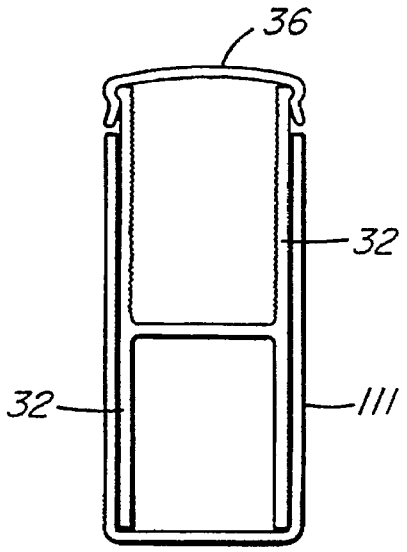
FIG. 6 is an end view of the bottom, elongated member with a spacer and a sleeve connected thereto.

There is also an optional casing 110 shown in FIG. 6 which covers the bottom of each bottom member 32, providing a more pleasing appearance.

Although the exact sequence of assembly can be varied somewhat, the general procedure is first to install the supports 74 in the required locations by means of bolts or screws extending through apertures 82 into the deck below. The top post connectors 88 are then screwed onto the top member 12 inside its channel 14. The flanges 98 and 100 of each connector 88 are then inserted into the top of each tube 76 to secure the top member in place. The foam members 70 are then inserted into the channel 14 of the top member and a spacer 54 is snapped in place over the bottom 31 of the channel.

Next the bottom members 32 are aligned below the top member with their channels 34 facing upwardly. The foam members 72 are then fitted inside the channels. The channels 47 of the bottom members are then fitted over the projections 84 on the supports 74. The spacers 57 can then be snapped in position over the tops 36.

The pickets 28 are now installed by inserting their tops 26 through the openings 64 in the top spacers 54. The tops are pushed upwardly to compress the foam members 70 as shown in FIG. 2. This provides enough clearance at the bottom 42 of each picket to allow the bottom to be inserted through one of the openings 64 of the bottom spacers 57. The pickets are then released and dropped in place into the channels 34 of the bottom members onto the foam members 72.

After all of the pickets have been installed, the bottom members 32 are then brought up towards the top member 12 so as to compress the foam members 70 and 72 and secure the pickets firmly in place as shown in FIG. 2. The bottom members can be secured in this raised position by screws inserted through the member 32 into projections 84. Alternatively, or additionally, this function can be accomplished by means of a plurality of bottom supports 104 fitted in place after the bottom member is raised.

It will be understood by someone skilled in the art that many of the details provided above are by way of example only and are not intended to limit the scope of the invention which is to be interpreted with reference to the following claims.

What is claimed is:

1. A railing, comprising:

a top member having a downwardly opening first channel with a bottom;

a bottom member having an upwardly opening second channel with a top;

a plurality of spaced-apart vertical pickets having longitudinal axes, each said picket having sides parallel to the longitudinal axis and opposite ends and having a top end in the first channel and a bottom end in the second channel;

resiliently deformable members in the channels between the ends of the pickets and the channels of the corresponding top and bottom members which bias the pickets away from the top and bottom members; and spacers adjacent the top and the bottom members, each said spacer being an elongated continuous member with a plurality of spaced-apart openings and having a connector engaging one of said top and bottom members, the pickets extending through the openings in the spacers.

2. A railing as claimed in claim 1, wherein a first said spacer engages the bottom of the channel of the top member and a second said spacer engages the top of the channel of the bottom member.

3. A railing as claimed in claim 2, wherein the spacers are resilient and U-shaped in section with inwardly directed projections on each side thereof forming the connectors.

4. A railing as claimed in claim 3, wherein the top member and the bottom member have sides outwardly directed projections on each said side thereof, the projections of the spacers fitting over the projections of the members.

5. A railing as claimed in claim 4, wherein the resiliently deformable members are elongated and extend along the first channel above the pickets and along the second channel below the pickets.

6. A railing as claim in claim 5, wherein the resiliently deformable members are of foam plastic.

7. A railing as claimed in claim 6, wherein the foam is closed-cell.

8. A railing as claimed in claim 7, wherein the resiliently deformable members are compressed by the pickets.

9. A railing as claimed in claim 1, wherein there are spaced-apart supports including vertical open-ended posts and top post connectors connecting each said post to the top member, each said post connector including a bottom portion extending into one of the posts and a top portion connected to the top member.

10. A railing as claimed in claim 9, wherein the bottom portion of each said top post connector is a pair of spaced-apart flanges having outer projections which grip the inside of one of the posts and the top portion is a pair of co-planar flanges against the top member.

11. A railing as claimed in claim 10, including fasteners connecting the top portion to the top member.

12. A railing as claimed in claim 9, wherein the bottom member is H-shaped in section, having upper and lower pairs of parallel flanges, each of the supports having a projection supporting the bottom member and extending between one said pair of flanges.

13. A railing as claimed in claim 12, wherein the projection is between the lower flanges.

14. A method of assembling railing apparatuses having an upper elongated member with a downwardly directed channel and a top surface forming the base of the channel, a lower elongated member with an upwardly directed channel and a bottom surface forming the base of the channel and a plurality of spaced-apart vertical pickets therebetween said pickets having longitudinal axes the method comprising:

placing resilient members within the channels;

fitting continuous spacer members to the channels, said spacer members having a plurality of spaced-apart openings, said resilient members being located between said top surface of said downwardly directed channel and a said spacer member and said bottom surface of said upwardly directed channel and a said spacer member;

inserting the pickets through the openings in the spacer members against the resilient members; and bringing the elongated members towards each other so the pickets compress the resilient members in a direction along the longitudinal axes of the pickets.

15. A method as claimed in claim 14, wherein the elongated members are fastened to support posts.

16. A method as claimed in claim 15, wherein the upper elongated member is fastened to the supports posts prior to inserting the pickets and the lower elongated member is secured in position after the elongated members are brought towards each other.

* * * * *